US007578745B2

(12) United States Patent
Wingerstahn

(10) Patent No.: US 7,578,745 B2
(45) Date of Patent: Aug. 25, 2009

(54) ELEVATED HAND-HELD MERRY-GO-ROUND

(75) Inventor: Paul S Wingerstahn, Fort Payne, AL (US)

(73) Assignee: Playcore, Chattanooga, TN (US)

( * ) Notice: Subject to any disclaimer, the term of this patent is extended or adjusted under 35 U.S.C. 154(b) by 333 days.

(21) Appl. No.: 11/703,027

(22) Filed: Feb. 6, 2007

(65) Prior Publication Data

US 2009/0137328 A1 May 28, 2009

(51) Int. Cl.
*A63G 1/12* (2006.01)
*A63G 1/00* (2006.01)

(52) U.S. Cl. ..... 472/18; 472/29; 472/33

(58) Field of Classification Search ..... 472/14, 472/18, 29, 32–34, 118; 482/34–37
See application file for complete search history.

(56) References Cited

U.S. PATENT DOCUMENTS 519,178 A * 5/1894 Douglas et al. ..... 211/163
1,916,809 A 7/1933 Patterson
3,090,617 A * 5/1963 Hjelte et al. ..... 482/143
D293,459 S 12/1987 McCombs
4,978,120 A * 12/1990 Greenwood ..... 472/18
D316,889 S 5/1991 Smith
D381,057 S 7/1997 Strawcutter et al.
5,997,403 A * 12/1999 Fonti ..... 472/19
6,572,483 B1 * 6/2003 Hoffman ..... 472/118
D559,935 S 1/2008 Wingerstahn
D559,936 S 1/2008 Wingerstahn
D568,434 S 5/2008 Wingerstahn

OTHER PUBLICATIONS

Goric Catalog Prices, 2006 prices; website screenshot; picture of device.

* cited by examiner

*Primary Examiner*—Kien T Nguyen
(74) *Attorney, Agent, or Firm*—Stephen J. Stark; Miller & Martin PLLC

(57) ABSTRACT

An elevated hand held merry go round provides a hand hold elevated a distance above a playing surface to which a user may grab and rotate through an unobstructed zone between the hand hold and the playing surface. In the preferred embodiment the hand hold may be tilted at an angle relative to the playing surface so the user may pump themselves to maintain the round momentum in a manner somewhat similar to an individual pumping themselves on a swing to maintain themselves swinging. Alternative embodiments lack the tilt may be made in various dimensions to accommodate various numbers of users and may have more than one set of locations for hand holds.

20 Claims, 2 Drawing Sheets

ELEVATED HAND-HELD MERRY-GO-ROUND

FIELD OF THE INVENTION

The present invention relates to a merry-go-round for use on playgrounds, and more particularly to an elevated device which provides at least one, and preferably a plurality of hand holds disposed about a central support by which users can grab a hand hold and utilize their momentum to rotate them about the center support in one of various embodiments.

BACKGROUND OF THE INVENTION

In the playground equipment business, there is always a perceived need for more fun to be had on the playground. The applicant recognizes this need for fun and endeavors to provide new products for playground use. Monkey bars provide a hand over hand lateral movement type play for users. Horizontally fixably supported bars provide a location for children to swing about such as to skin the cat or otherwise swing and play thereon.

Traditional merry-go-rounds provide a structure onto which children or even adults can push the merry-go-round around a center support connected to the ground and then place their feet on a platform to go round and round the center support. While various forms of merry-go-rounds have been developed for use for standing and/or sitting thereon, the applicant is unaware of an attempt at making a merry-go-round type structure onto which users can hang with their hands therefrom and be supported off the ground without contacting the ground. U.S. Pat. No. 4,286,781 shows a typical merry-go-round structure as has been available for many years. U.S. Pat. No. 4,982,949 shows a sitting merry-go-round arrangement.

Accordingly, an improved merry-go-round type play device is believed to be an advantageous addition to a playground.

SUMMARY OF THE INVENTION

It is a present object of the present invention to provide an improved merry-go-round type device for a playground.

It is another object of the present invention to provide a rotating structure having hand holds by which at least one user can grab and swing about the center support.

It is still another object of the present invention to provide an elevated merry-go-round having a plurality of hand holds which allow users to radially rotate about the center support while suspended by their hands.

It is another object of the present invention of at least some embodiments of the present invention to provide a center support having hand holds angled at a tilt relative to the center support whereby a specific hand hold passes through multiple elevations during a revolution about the center support.

In the presently preferred embodiment, a merry-go-round of the present invention provides a center support which connects to a frame a distance above the ground. More preferably, the center support elevates the frame a sufficient distance so that hand holds connected to the frame are at least a sufficient distance so that the feet and/or knees of a user do not touch the ground as they rotate about the center support. In some embodiments, the center support may be tilted where it connects to the frame and in other embodiments the center support portion may be supported in a pole like fashion perpendicular to the ground where it connects to the hand holds.

In some embodiments, a double ring type structure may be employed wherein a top ring is utilized to provide additional strength and support to the frame (and possibly additional hand holds) while in other embodiments such additional strength and/or hand holds may not be necessary or desired. By tilting the hand holds somewhat relative to a horizontal plane to the ground (such as perpendicular to a vertically extending pole, the applicant has found an embodiment which adds an additional type of fun).

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
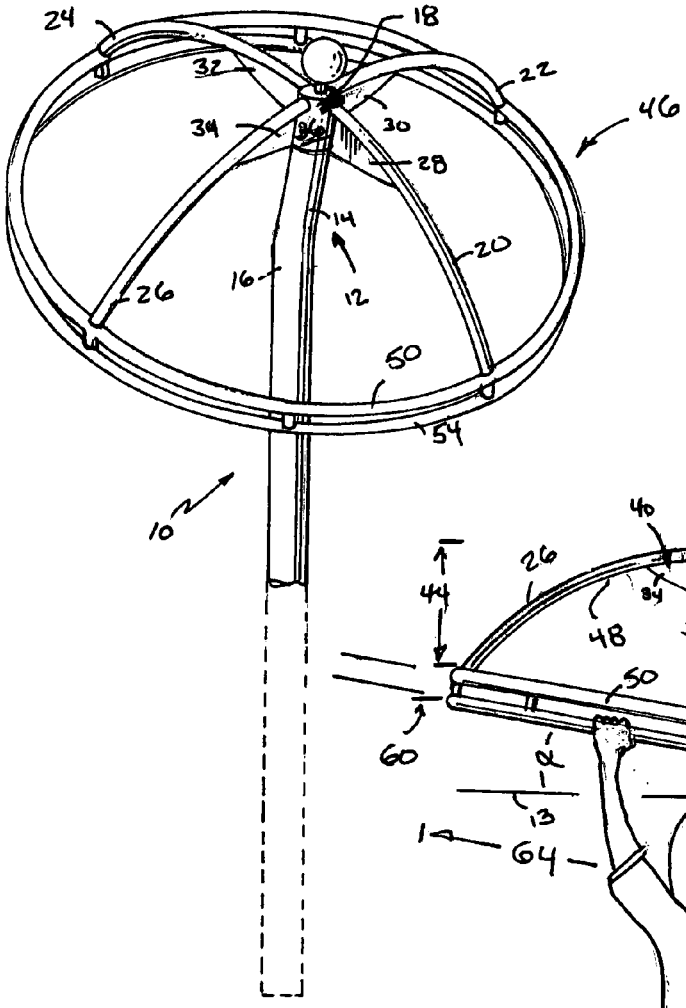
FIG. 1 is a perspective view of a portion of first presently preferred embodiment of the present invention.
Figure 2:
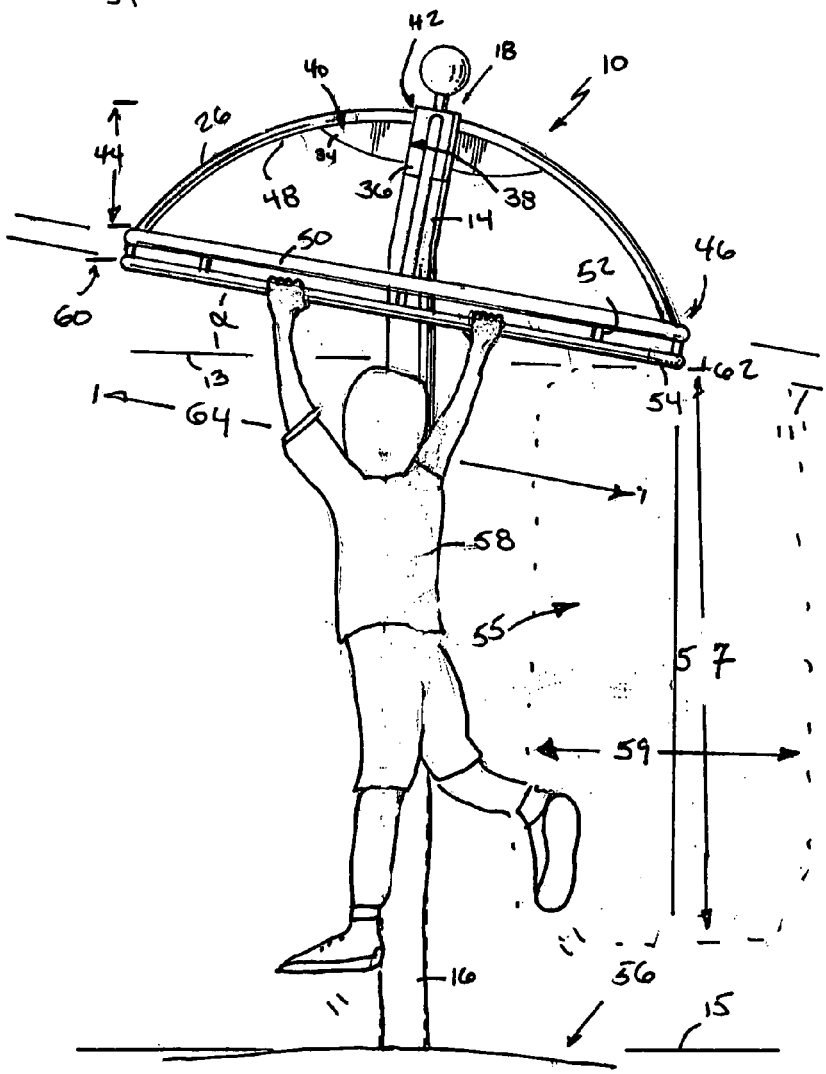
FIG. 2 is a side plan view of the embodiment shown in FIG. 1 installed on a with a child playing thereon.

FIGS. 1 and 2 show a merry-go-round 10 of the presently preferred embodiment of the present invention. This merry-go-round 10 has a center support 12 which, in this embodiment, has a hub extension 14 connected to an upwardly extending post 16. In this embodiment is illustrated the hub extension is tilted off axis with the post 16. In the illustrated embodiment, this angle of tilt (alpha, $\alpha$) is at about 10°, but a tilt of a few degrees such as up to about 5° or even 15° or more in other embodiments could be found to provide a desirable play effect as will be described below. Angle a could also be defined as an angle of a plane 11 extending through hand hold member 54 relative to plane 13 which is a parallel plane to plane 15 which is essentially the plane of the playing field 56 and/or a plane extending perpendicular to center support extending to post 16.

Connected to the hub extension 14 is a hub 18 which is illustrated connected to arms 20, 22, 24, 26 at exterior surface 36 or otherwise hub 18 with a majority of the length of the arms located below the hub 18. Gussets 28, 30, 32, 34 are useful to assist in strengthening the structure and are illustrated connected to the exterior surface 36 of the gusset 18. A first end 38 of gusset 34 is illustrated connected to the exterior surface 36 of hub 18 while the upper surface 40 of gusset 34 is illustrated connected to arm 26. In the embodiment illustrated, the arms 26 extend from a hub connection point 42 downwardly to a first elevation change 44 in the preferred embodiment. In other embodiments, the arms 20, 22, 24, 26 could drop less, drop none or even elevate hand hold assembly 46 at at least some portion of a revolution as will be described in further detail below.

Arms 20, 22, 24, 26 are preferably downwardly directed and/or curved with a curve of the upper portion 40 of gusset 34 and others corresponding to the inner curve 48 of arms 20, 22, 24, 26 as illustrated.

Internal to hub 18 are preferably one or more bearings. In the preferred embodiment two bearings are pressed fit into the hub 18 on the hub extension 14. In the preferred embodiment, arms 20, 22, 24, 26 connect to a first member 50 which in some embodiments may provide a hand hold locations. In the preferred embodiment, spacers 52 separate first member from hand hold member 54 which provides a plurality of hand holds which can be seen in FIG. 2 where a user such as a child or adult may grab the hand hold member 54 and propel it around at least a portion of the center support 12 without being interfered with by first member 50. Others may also grab hand hold member 54 and/or first member 50. Hand holds preferably have a round cross section and are disposed on hand hold member 54 such as in the form of a loop which is substantially continuous as illustrated and round, but could be elliptical and/or discontinuous in other embodiments such as having segments missing from the loop, etc. The first member 50 is similarly constructed to the hand hold member and the preferred embodiment but has a slightly larger diameter, and other embodiments could have similar or dissimilar construction of the handle member 54. In fact, users may elect to grab the first member 54 in addition to or instead of the hand hold member 54 in some embodiments. First member is a 1¼ in. pipe and hand hold member is a 1.029 in. pipe both bent into rounded across to provide at least portions of round loops in the preferred embodiment but other dimensions and/or shapes could be utilized in other embodiments.

Although center support 12 and post 16 are shown extending from the ground 56 upwardly, in alternative embodiments, it may be supported from above as would be understood by those of ordinary skill in the art. In FIG. 2, a user illustrated a child 58 is shown moving from right to left running and jumping and grabbing the hand hold support 54 at which time the momentum would assist in carrying him (or her) from right to left upwardly until reaching a maximum elevation 60 at which time gravity and/or momentum would assist in pulling him back toward lower elevation 62 which is illustrated as being greater than three, four or even five feet at five feet, two inches.

Figure 3:
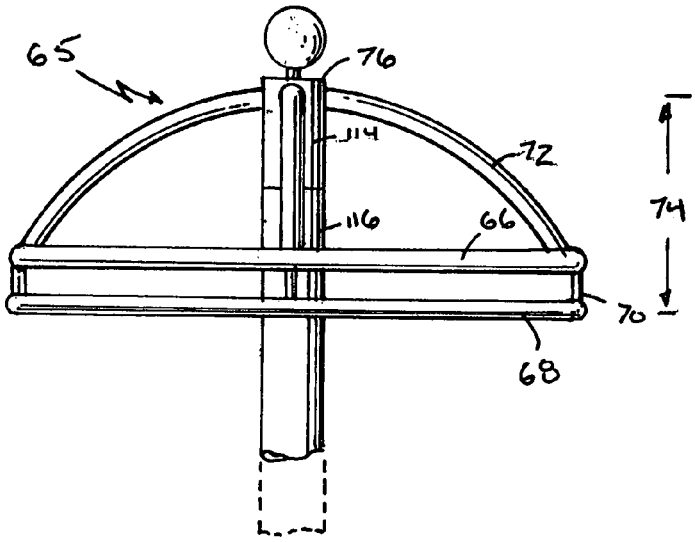
FIG. 3 is a front plan view of a first alternatively preferred embodiment of the present invention.

In practice, the upper elevation 60 and lower elevation 62 are assisted in being created as a result of the length 64 as shown in FIG. 3 as effected by the tilt of the hub extension 14 relative to the post 16 and/or to a device supporting the hub extension 14. Length 64 in the preferred embodiment illustrated is about over four feet and is illustrated at about six feet.

When providing a sufficient change in upper and lower elevations 60, 62, the applicant has discovered that a user such as child 58 may pump their body inwardly and outwardly at appropriate times during revolution about the center support 12 so that they may maintain the motion about the center support 12 by themselves. This is somewhat like "pumping" a swing to maintain its motion by one's self.

FIG. 3 shows an alternatively preferred embodiment of a merry go round 65 in which the hub extension 114 is essentially collinearly with the post 116. In fact, in this embodiment, the applicant has discovered that gussets 34 may not be preferred to handle similar loads as that shown in the embodiment of that of FIG. 1 and FIG. 2 since the pumping action is not affected with the change in elevation as occurs with the embodiment in FIGS. 1 and 2 (and the anticipated loading is much smaller). Nevertheless, in this embodiment, a first member 66 is illustrated above hand hold member 68 which is separated by spacers 70. Arms 72 are illustrated downwardly extending to a first member 66 but may downwardly extend to either of the first member 66 if utilized and/or the hand hold member 68. The length 78 may be the same length as the embodiment shown in FIG. 1 and FIG. 2, such as about six feet or may be smaller such as about four feet or larger. The first member 66 may have a round cross section or other shapes and somewhat similar to the hand hold member 68 illustrated. The hand hold member 68 may be similar or dissimilar to that shown in the embodiments of FIG. 1 and FIG. 2.

Figure 4:
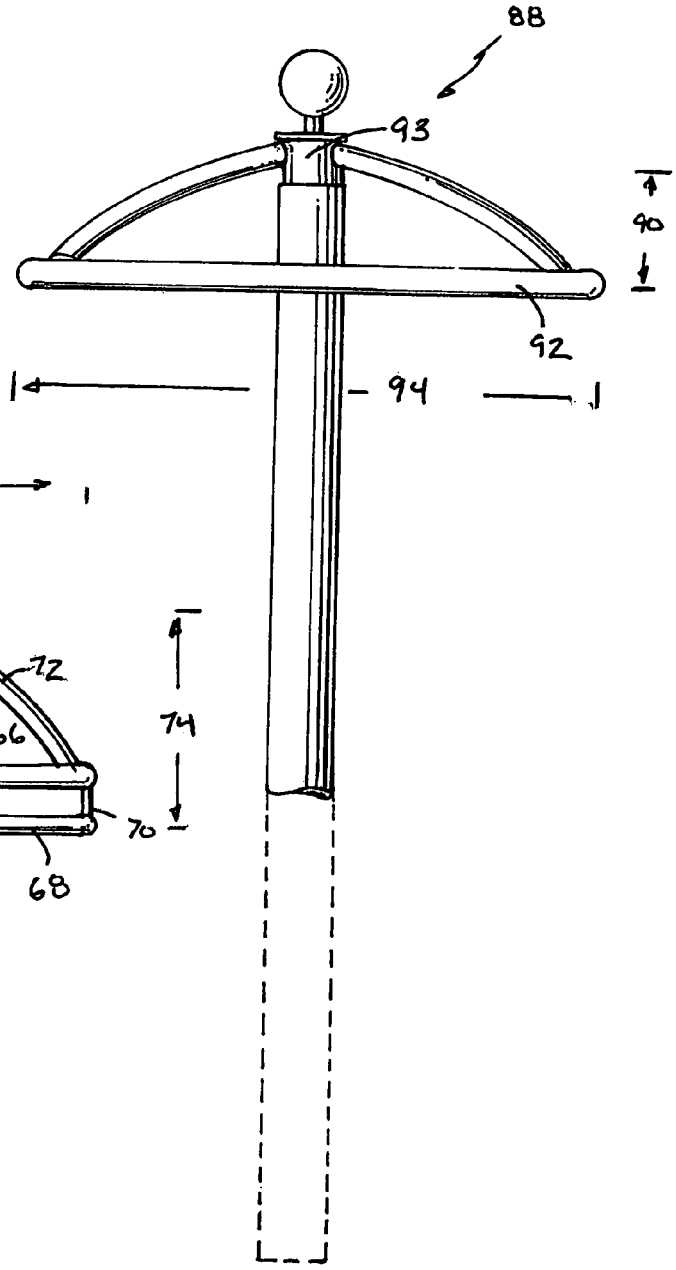
FIG. 4 is a front plan view of a second alternatively preferred embodiment of the present invention.

While the embodiment of FIG. 1 and FIG. 2 are a first preferred embodiment, the embodiment of FIG. 3 is also in production and has been tested by the applicant. FIG. 4 shows yet another embodiment of a smaller version having less elevation drop 90 than elevation drop 44 or 74 of the other two embodiments and is also in production at this time. The embodiment of FIG. 4 has a hand hold member 92 without a separate support member illustrated as first members 50 and 66 in the other embodiments. Furthermore, the hub 93 is significantly smaller than the hubs 76, 18 in the other two members. Finally, the length 94 may be significantly shorter than length 78 and 64 of the other embodiments such as about two feet or other dimension. While these three embodiments are presently preferred designs, it is likely that there are others which can be provided based on the teachings herein.

Although only one child 58 is shown playing in the embodiment of FIG. 2, it can be easily seen that two, four, and possibly many more can also play at the same time.

In FIG. 1, the first member 50 is illustrated to be somewhat ring shaped as is the hand support member 54. However, they need not be continuous rings as illustrated and could be discontinuous and also need not be circular as illustrated. They could be oval, angularly connected such as a pentagon, or other appropriate geometrical shape. Furthermore, they need not provide a continuously circular path about the center support 12, but instead could provide a wobble such as by providing an oval shape for a hand hold member 54 and/or a cam as would be understood by those of ordinary skill in the art.

Various elevations 60, 62 and others can be selected based on the anticipated heights of children 58 and/or adults which play with the merry-go-round 10, 65 and/or 88. An unobstructed zone 55 is located between the hand hold members 54, 68, 92 and the playing surface 56 as shown in FIG. 2. This zone is somewhat of a squared donut shape in the preferred embodiments, but could have an elliptical nature, or other shape in other embodiments. The unobstructed zone has a height 57 of at least three feet and preferably at least about five feet and a width 59 of at least a foot and a half if not about two, four or six feet preferably centered at the hand hold member 54 following a path below the hand hold member 54 where a user 58 is traversing between the hand hold member and the playing surface 56. The unobstructed zone allows the user 58 to rotate unobstructedly. Other shaped unobstructed zones 55 may be provided with other embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is clamed herein is:

1. An elevated merry go round comprising:

a hub extension supported a distance above a playing surface;

a hub rotatably connected to the hub extension;

a hand hold member having a plurality of hand holds cantileveredly supported by downwardly extending arms radially coupled to and extending from the hub toward the hand hold member;

wherein the hand hold member rotates at least substantially in a first plane angled at least five degrees off of a parallel plane to the playing surface extending through a portion of the hand hold member with a majority of the length of the arms located below the hub; and an at least substantially unobstructed zone located at least substantially between the hand holds and the playing surface providing a space for a user so that a user may grab the hand hold and rotate while hanging about the hub extension in the unobstructed zone.

2. The elevated merry go round of claim 1 wherein the unobstructed zone has a minimum height of at least four feet.

3. The elevated merry go round of claim 2 wherein the unobstructed zone has a minimum height of at least five feet and the hand holds rotate through a diameter of at least four feet.

4. The elevated merry go round of claim 1 wherein the hand hold member comprises a loop, said loop oriented parallel to the first plane.

5. The elevated merry go round of claim 4 further comprising a first member parallel to the hand hold member and connected to at least one of the hand hold member and arms.

6. The elevated merry go round of claim 5 wherein a first member provides a plurality of hand holds.

7. The elevated merry go round of claim 1 wherein the hand hold member rotates at at least about 10 degrees relative to the parallel plane to the playing surface.

8. The elevated merry go round of claim 1 wherein the hub extension is connected to a center support which extends upwardly from the playing surface.

9. The elevated merry go round of claim 1 wherein the hand hold member is disposed in a first plane and further comprising a first member located parallel to the first plane, but not coplanar with the first plane, said first member connected to the arms.

10. The elevated merry go round of claim 9 wherein the first member and the hand hold member are connected with spacers.

11. The elevated merry go round of claim 1 wherein the hand hold member has a highest elevation which is below a lowest elevation of the hub.

12. The elevated merry go round of claim 1 further comprising gussets extending from the hub to the arms.

13. The elevated merry go round of claim 1 wherein the downwardly extending arms further comprise a downwardly extending curve along the length of the arms.

14. An elevated merry go round comprising:

a hub extension fixedly supported a distance above a playing surface with said hub extension angled at at least about five degrees relative to a plane parallel to the playing surface;

a hub rotatably connected to the hub extension;

a hand hold member having a plurality of hand holds cantileveredly supported by arms having a length connected to the hub; said arms elevationally displacing the hand hold member outside of a plane of rotation extending through the hub with a majority of the length of the arms located below the hub; and an at least substantially unobstructed zone located at least substantially between the hand holds and the playing surface, said unobstructed zone having a height of at least three feet and a width of at least about two feet located below and following a path of a first hand hold rotated 360 degrees about the hub extension.

15. The elevated merry go round of claim 14 wherein the loop is round and has a diameter in a range of about three to about six feet.

16. The elevated merry go round of claim 14 further comprising a first member connected to at least one of the arms and extending in a plane parallel, but not coplanar, to a plane containing the hand hold member.

17. The elevated merry go round of claim 14 having two bearings connecting the hub to the hub extension.

18. The elevated merry go round of claim 14 wherein the arms extend radially from the hub to the hand hold member.

19. The elevated merry go round of claim 14 wherein hand hold member has a maximum elevation below a minimum elevation of the hub.

20. The elevated merry go round of claim 14 further comprising a first member parallel to, but not coplanar with, the hand hold member providing a plurality of hand holds.

* * * * *